US007455749B2

(12) United States Patent
Stromberg et al.

(10) Patent No.: US 7,455,749 B2
(45) Date of Patent: Nov. 25, 2008

(54) GAS PHASE CONTINUOUS DIGESTER HAVING AN INVERTED TOP SEPARATOR WITH LIQUOR INJECTION

(75) Inventors: C. Bertil Stromberg, Bolton Landing, NY (US); Keith P. Vogel, Queensbury, NY (US); John F. Bolles, Queensbury, NY (US); Patrick J. Sullivan, Argyle, NY (US); Brian F. Greenwood, Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 246 days.

(21) Appl. No.: 11/518,323

(22) Filed: Sep. 11, 2006

(65) Prior Publication Data

US 2007/0000626 A1 Jan. 4, 2007

Related U.S. Application Data

(62) Division of application No. 10/303,774, filed on Nov. 26, 2002, now Pat. No. 7,105,076.

(60) Provisional application No. 60/353,191, filed on Feb. 4, 2002.

(51) Int. Cl.
*D21C 3/26* (2006.01)

(52) U.S. Cl. ..... 162/17; 162/18; 162/19; 162/41; 162/56; 162/246; 162/239

(58) Field of Classification Search ..... 162/17, 162/18, 19, 41, 56, 52, 237, 246, 249, 251, 162/239

See application file for complete search history.

(56) References Cited

U.S. PATENT DOCUMENTS

| | | | |
|---|---|---|---|
| 3,532,594 | A | 10/1970 | Richter |
| 5,413,677 | A | 5/1995 | Collins |
| 6,024,837 | A | 2/2000 | Laakso et al. |
| 6,174,411 | B1 | 1/2001 | Laakso et al. |

*Primary Examiner*—Mark Halpern
(74) *Attorney, Agent, or Firm*—Nixon & Vanderhye P.C.

(57) ABSTRACT

A method for adding cooking liquor into a vapor phase continuous digester for producing chemical cellulose pulp from cellulose chips including: introducing a slurry of the cellulose chips from a feed system to an inverted top separator in a top vapor phase section of the digester; distributing the slurry of the cellulose chips from the top separator into the vapor phase section of the digester; passing liquor through a conduit included with the drive shaft assembly of the top separator, and introducing the liquor from the conduit into the slurry as the slurry flows through the top separator or is distributed from the separator into the vapor phase section.

20 Claims, 4 Drawing Sheets

GAS PHASE CONTINUOUS DIGESTER HAVING AN INVERTED TOP SEPARATOR WITH LIQUOR INJECTION

RELATED APPLICATION

This application is a divisional of application Ser. No. 10/303,774 filed Nov. 26, 2002, now U.S. Pat. No. 7,105,076, and claims priority to provisional application Ser. No. 60/353,191, filed Feb. 4, 2002, which are incorporated by reference herein in their entirety.

FIELD OF INVENTION

The invention relates to vapor-phase digesters used to process cellulosic fibers into pulp. The invention particularly relates to the injection of cooking liquor into the vapor section of a digester.

BACKGROUND AND SUMMARY OF THE INVENTION

Digesters are pressure cooking vessels used to process cellulosic fibrous material, such as wood chips. The digester applies pressure and cooking liquor to process the chips into cellulose pulp from which paper products may be made. A dual-phase or vapor-phase digester includes a pressure vessel that is partially filled with a slurry of the cellulosic fiber and cooking liquor and has a super-atmospheric steam zone (also referred to as the gas zone) above the slurry. Since this gas zone is compressible compared to the liquid zone below it, the pressure within a vapor-phase digester is typically determined by the pressure of the gas at the top of the digester.

Prior art vapor-phase digesters are illustrated in U.S. Pat. Nos. 6,024,837; 3,380,883; 3,429,773; 3,532,594; 3,578,554 and 3,802,956. Recently-issued U.S. Pat. No. 6,024,837 is commonly owned with this application, and is incorporated by reference in its entirety.

In a vapor-phase digester, the wood chips are typically heated by exposure to steam as the chips are introduced to the steam-filled zone at the top of the digester. A vapor-phase digester directly exposes chips to steam for heating by having a chip level that is above the level of the liquid in the digester. The chips are exposed to steam as they are distributed in the vessel by a top separator device and as the rest on the top of the chip pile.

Vapor phase digesters are known to have inverted top separators. Top separators are used to convey a slurry of wood chips, or other cellulosic material, into a pressure vessel of a continuous digester. The chips are "cooked" as they move from the top of the chip pile and progress down into the slurry through the digester vessel, which is generally a vertical column oftentimes having a height greater than 100 feet (33 meters). The inverted top separator is mounted in the top section of the digester. The top section of the vessel contains a vapor portion, and the portion of the vessel below the vapor is filled with a liquid-chip slurry.

Wood chips, or other comminuted cellulosic fibrous material, are typically fed to the inlet of a continuous digester using a separate feed system. The chip feed system typically includes equipment for de-aerating, heating, and pressurizing the chips, and introducing cooking liquor to the chips to form a slurry of chips and liquor that flow to the top separator of the digester. In a vapor-phase digester, the chip slurry is introduced into a top separator which distributes the chips to a gas space at the top of the digester. An inverted top separator removes some cooking liquor from the slurry before distributing the wood chips outward at the top of the vessel. The top separator distributes the chips into the steam of the upper section of the digester vessel. The wood chips overflow the top separator and fall, through the steam, to the chip pile below the separator.

A top separator is an inverted screw conveyor. The slurry of chips and liquor are fed to the bottom of the conveyor, via a conduit that is connected to the chip feed system external to the digester vessel. The chips are carried upward in the screw conveyor. As the chips overflow the top of the conveyor, they fall freely in the steam-filled atmosphere of the upper section of the vapor-phase digester. A screen drum surrounds the screw conveyor to allow excess liquid to flow out of the chips being conveyed to the top of the separator.

SUMMARY OF INVENTION

There is a need to add liquor to the top section of the vessel. A liquor inlet system has been developed that directs liquor in through passages in or adjacent the shaft driving the chip conveyor of an inverted top separator. The separator shaft extends through the top of the digester and is aligned with the vertical axis of the digester. The separator shaft rotationally drives the screw conveyor of the separator. The separator shaft has been adapted to provide passages for liquor, such as white liquor, to pass into the vessel and to be distributed onto the chips overflowing the top separator and as the chips are exposed to steam.

Several arrangements are disclosed for coupling a liquor inlet to a top separator shaft. A top liquor inlet may comprise a sleeve around the separator shaft, a conduit adjacent the shaft, a passage in a hollow shaft, or other conduit liquor flowing into the top separator. The liquor passage may extend along the separator shaft to liquor outlet ports that are above the chip outlet of the separator conveyor. In a second embodiment, the top separator shaft above the digester is not modified, but a liquor inlet pipe extends at an angle to a stationary sleeve around the shaft, just above the top separator. The sleeve fits into a rotating collar around the separator shaft. The collar has liquor discharge ports above the separator. In a third embodiment, a liquor inlet pipe extends through the side of the digester vessel and connects to a bottom end of the separator shaft. The top separator shaft has a liquor passage extending from its bottom to discharge ports above the top separator.

In one embodiment, the invention is a continuous digester for producing chemical cellulose pulp from cellulose chips, comprising: a continuous digester vessel having a lower section filled with the cellulose chips and an upper gas-filled section; an inverted separator at least partially in said upper section which introduces chips and liquid into said digester vessel and separates some of the liquid from the chips, wherein said separator includes a drive shaft connected to a conveyor, and a liquid discharge port proximate to the drive shaft and arranged proximate to a chip discharge of the separator.

Advantages of the present invention include (without limitation): injection of liquor into the top section of a vapor phase digester; dilution of black liquor in the digester by the injection of liquor; facilitation of the extraction of black liquor from lower sections of the digester vessel by providing additional liquor injected at the top of the vessel; improvement of the washing ability of the digester by diluting black liquor in the vessel with liquor added to the top of the digester; increase alkali properties of the liquor in the digester by injecting white liquor at the top of the vessel; modifying the cooking chemistry by injecting other chemicals or process additives, and a more uniform distribution of liquor at the top separator by injecting liquor at the center of the top separator.

DETAILED DESCRIPTION OF THE DRAWINGS

Figure 1:
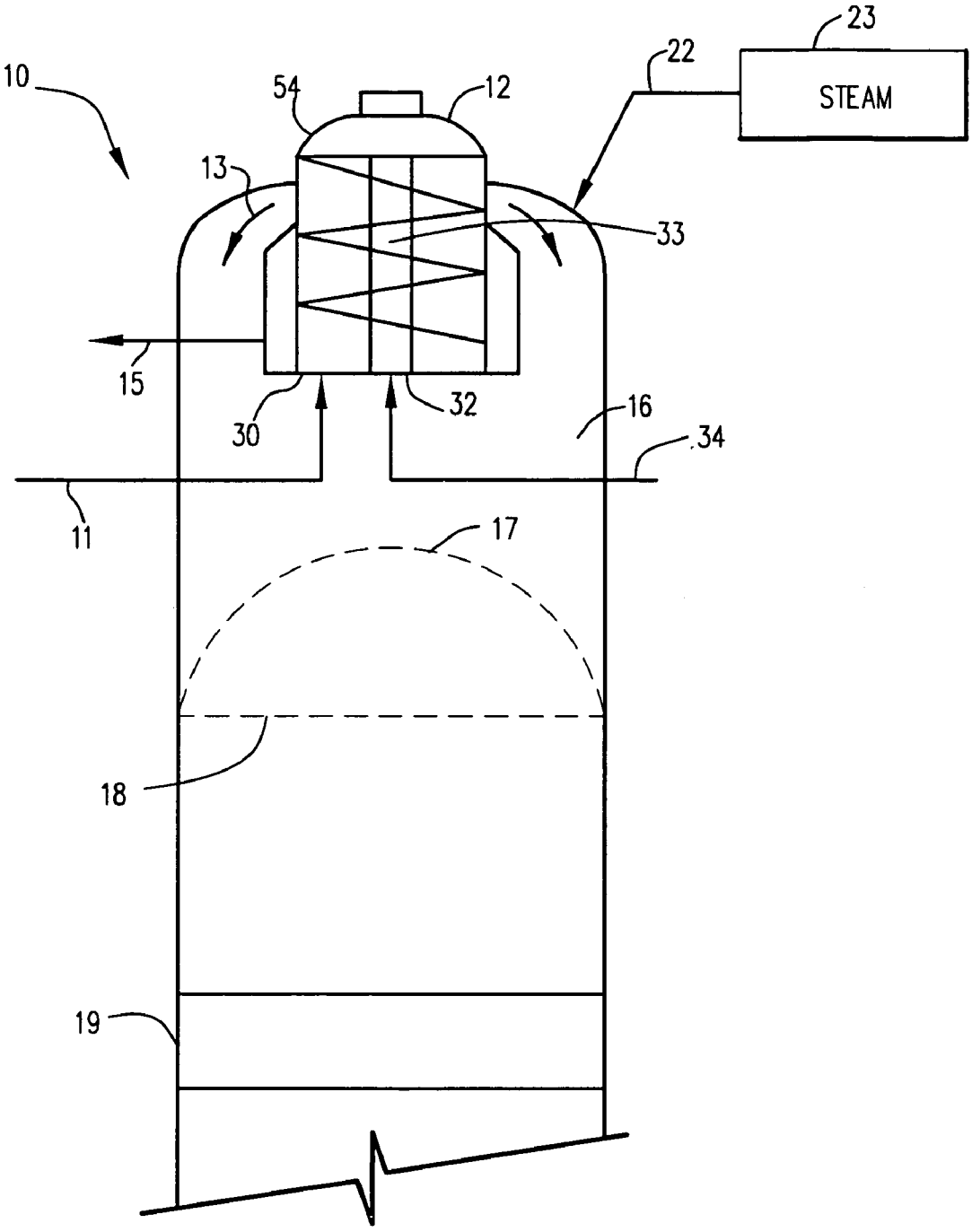
FIG. 1 is a schematic side view, partly in cross section and partly in elevation, of an inlet and upper section of a vapor-phase digester, having various (alternative) liquor injection devices.

FIG. 1 illustrates the top section of a vapor-phase continuous digester 10. The digester may be the only digesting vessel in a pulping system, or may be one of two or more vessels, where another vessel may be an impregnation vessel. The vapor-phase digester 10 receives a slurry of comminuted cellulosic fibrous material, typically wood chips, mixed in with cooking liquor, such as kraft white liquor. The slurry is typically first treated in a chip feed system, for example, a Lo-Level™ feed system as sold by Andritz Inc. of Glens Falls, N.Y.

The vapor-phase digester of FIG. 1 is fed a slurry of chips and liquor in an inlet conduit 11. The slurry is introduced to the digester using a vertically-oriented screw conveyor 12, known in the art as an "inverted top separator". A modification may be made to the top separator to provide an axially-offset chip inlet 30 and a liquor inlet 32. The liquor inlet is aligned with the vertical axis of the top separator, and is provided at the bottom of the drive shaft 33 of the separator (See FIG. 2).

The chip slurry is transported upwardly by a screw conveyor 38 in the separator 12. Chips and liquor are discharged from the top of the separator 12, as shown by arrows 13. As the slurry is transported upwardly, some liquor is removed from the slurry in the top separator by extracting the liquor through a cylindrical screen 14 and returning the extracted liquor to the feed system by way of conduit 15. The chips and liquor 13 discharged from separator 12 fall through a gas-filled zone 16 onto a chip pile 17. Steam is supplied to the gas zone 16 via a steam conduit 22 and a steam source 23.

To continue the steam heating of the chips, the level of the chip pile 17 is maintained above the level of the cooking liquor 18, as seen in FIG. 1. After steam heating and as the chips sink down into the vessel, the chips are immersed in cooking liquor as they pass below the liquid level 18, where the cooking process continues. Screens 19 (at various levels in the liquid portion of the digester) may be used in a conventional manner to remove some black cooking liquor from the chips flowing downward through the vessel of the digester. Additional cooking liquor may be injected into the digester, usually at various screen levels.

Figure 2:
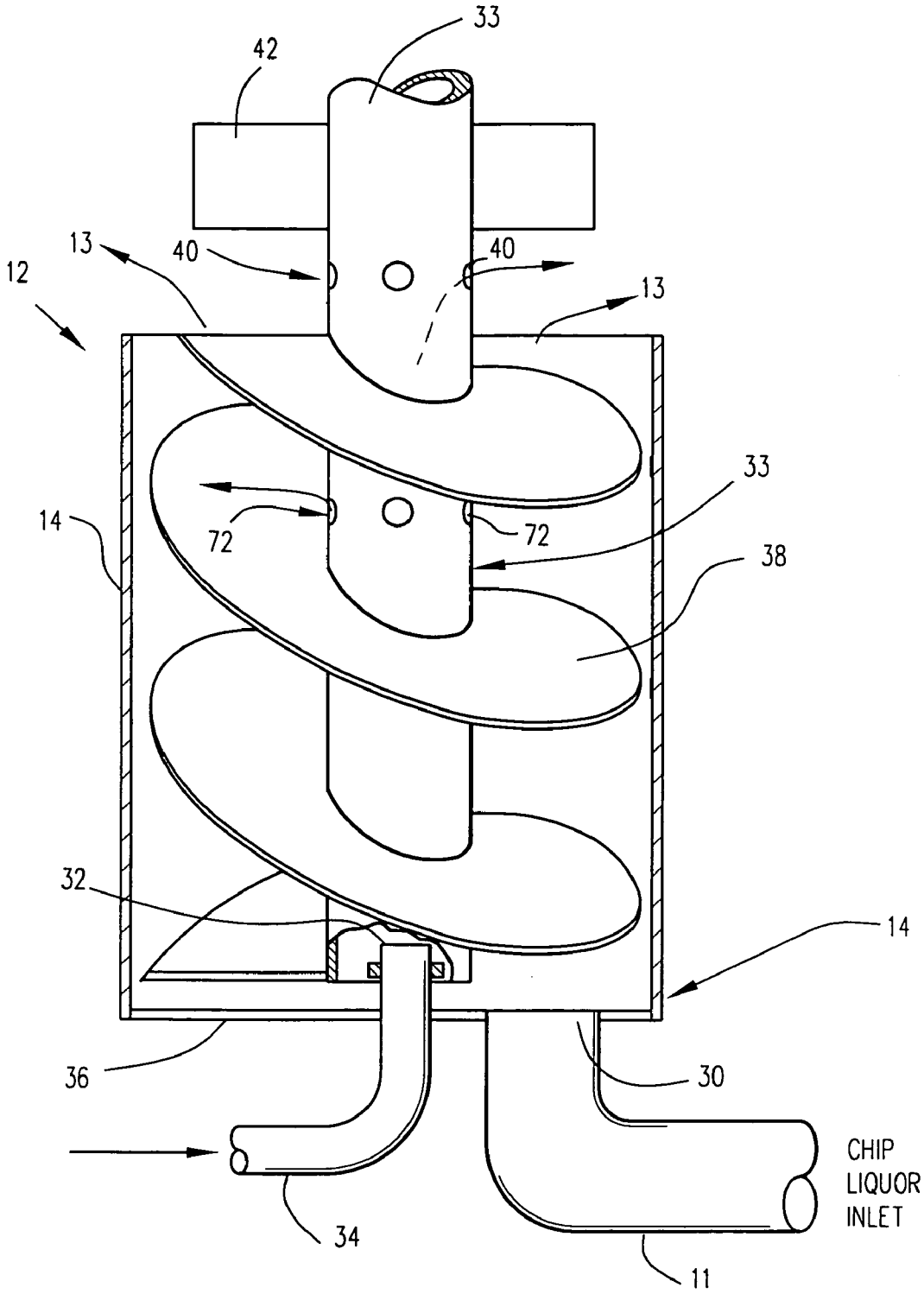
FIG. 2 is an enlarged side view of a bottom inlet liquor injection device for an inverted top separator.

FIG. 2 shows an enlarged view of a top separator 12 having a center bottom inlet 32 connected to a liquor conduit 34. The conduit 34 is connected to a supply of liquid, such as white liquor, filtrate, black liquor, and may include additives to enhance the pulping chemistry. The conduit may provide liquid under pressure such that the liquid discharges under a pressure force from ports 40 and 72 above and adjacent the chips in the top separator.

The top separator (TS) includes a cylindrical side screen 14 and a bottom screen 36, that together form a screen drum that allows excess liquid from the chip slurry to be removed as the chips move upward on the screw conveyor 38. Within the screen drum is a screw conveyor 38 that moves the chips upward as they are received through the bottom off-axis inlet 30. Chips are discharged from the top of the top separator, as indicated by arrow 13. As they are discharged, the chips are exposed to steam and fall onto the underlying chip pile.

White liquor flows upward through a hollow screw drive shaft 33 up through the top separator and out through outlet ports 40, above the screw conveyor. The liquor is discharged over the chips overflowing the screw conveyor 38. As the chips flow out of the top of the conveyor, they are coated with the white liquor as they are exposed to steam. Paddles 42 on the top separator are above the liquor outlet and rotate with the shaft 33 and screw 38. These paddles facilitate the dispersion of the chips into the steam.

Figure 3:
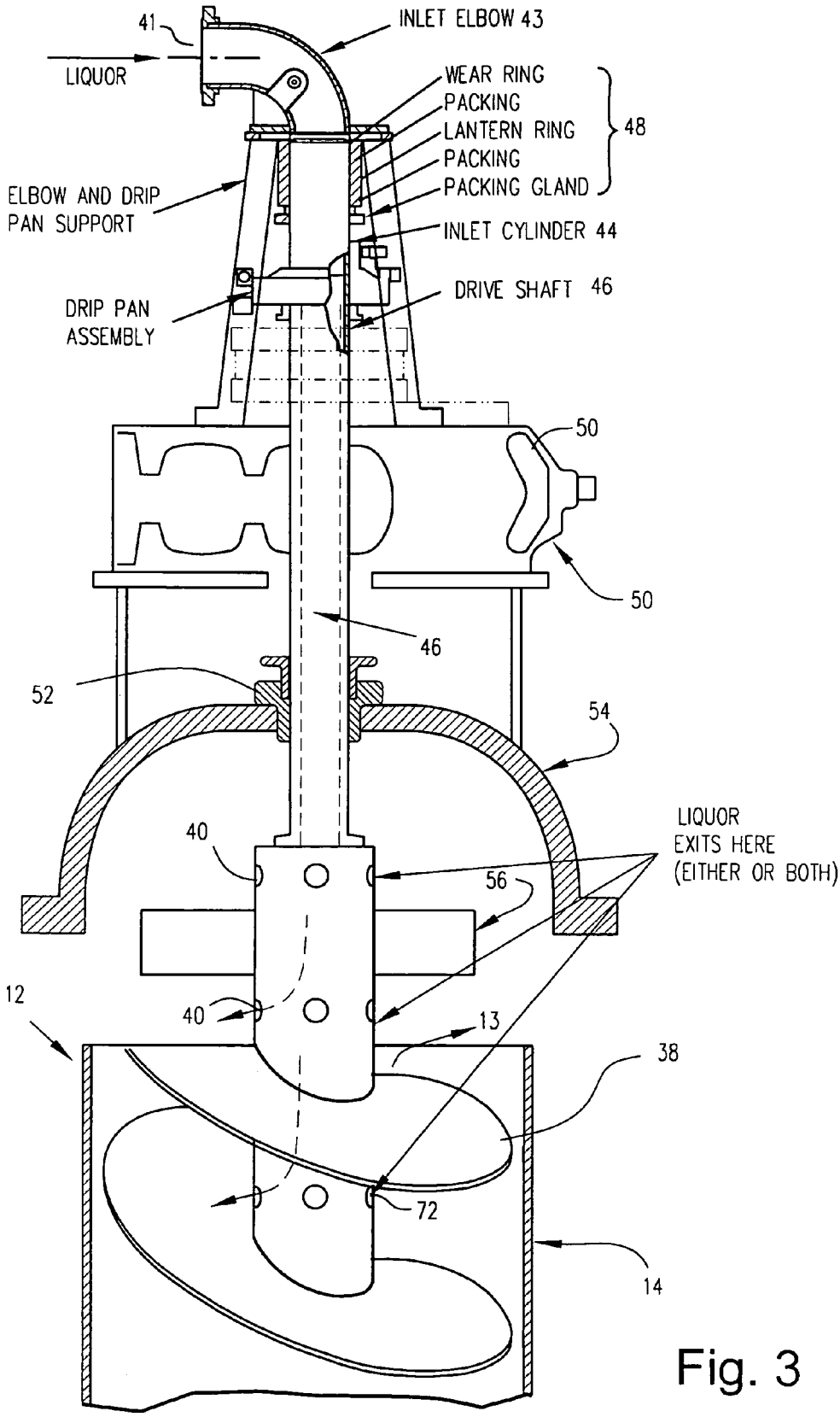
FIG. 3 is an enlarged side view of a second embodiment of a coaxial inlet liquor injection device for an inverted top separator.

FIG. 3 is an illustration of a second embodiment of a liquor inlet to the top separator 12, where the liquor inlet 41 is coupled to the top of the pressure vessel. The liquor inlet 41 passes through a stationary inlet elbow 43 that couples to a rotating inlet cylinder 44 that is coaxial with the rotating drive shaft 46 of the top separator 12. The drive shaft may be hollow to allow white liquor to flow through a center passage of the drive shaft 46 from inlet cylinder 44. The inlet cylinder 44 may rotate with the drive shaft and is mounted in a conventional pack box 48. A gearbox 50 rotationally drives the drive shaft, inlet cylinder, and the top separator screw conveyor 38. The drive shaft extends through a pack box 52 at a hemispherical top separator head 54 of the digester vessel. Double pressure-seal pack boxes are known and could be used here. The drive shaft is part of a drive shaft assembly that comprises the vertical drive shaft 46 extending through the top of the digester and down to the top separator and/or the shaft 33 extending through the screw conveyor of the top separator. The outlet ports 40, 72 for liquor may be on the drive shaft assembly, e.g., shaft 46 and/or shaft 33. The drive shaft assembly may also include a collar 62 (see FIG. 4) with outlet ports 40 for distributing liquid. The drive shaft assembly does not include the screw conveyor 38. However, the screw conveyor may be attached to the drive shaft assembly.

The drive shaft 46 of the top separator extends downward through the head 54 of digester vessel. The drive shaft supports the rotating chip paddle 56 and rotating screw conveyor 38 in the vessel. Outlet ports 40 on the drive shaft provide an output for liquor flowing down along the drive shaft. The outlet ports 40 are arranged above the top separator screw conveyor to discharge white liquor on the chips overflowing the top separator and falling into the steam vapor. The outlet ports 40, 72 for the liquor may be arranged both above and/or below the mixing paddles 56 that are connected to the drive shaft, above the top separator. Additionally, these outlet ports may be positioned further down the separator, such as below the first flight of the conveyor screw 38. The outlet ports may be arranged around the circumference of the separator shaft, and may or may not rotate with the shaft.

Figure 4:
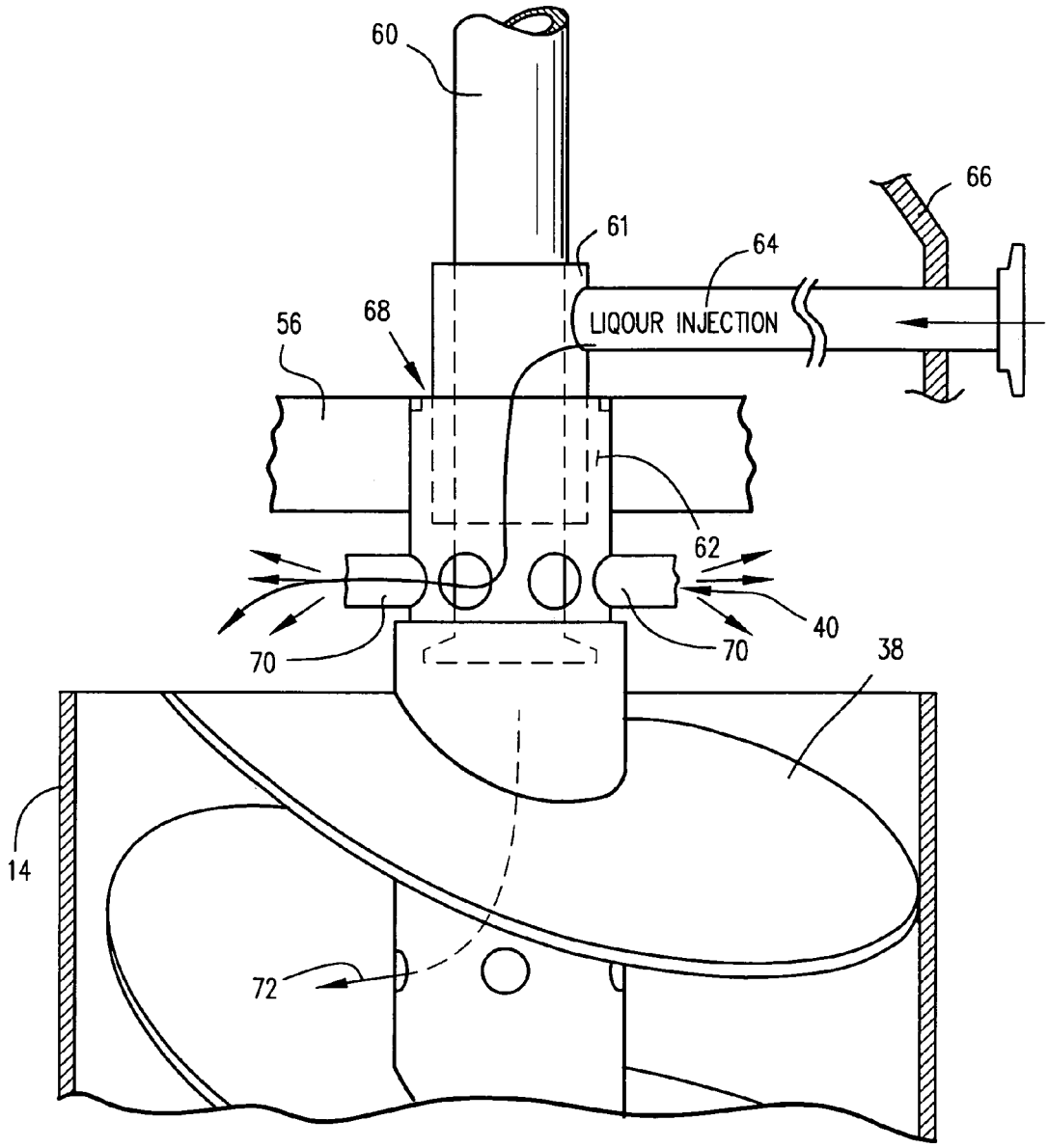
FIG. 4 is an enlarged side view of a top coaxial inlet liquor injection device for an inverted top separator.

FIG. 4 shows a third embodiment of a device for injecting liquor to the top of a top separator. A rotating drive shaft 60 for the top separator extends downward into the digester vessel and is connected to the screw conveyor of the top separator. A sleeve 61 extends around the top separator shaft, just above the paddles 56 and screw conveyor 38. The sleeve 61 may remain stationary around the rotating drive shaft.

The sleeve 61 fits into a rotating collar 62 that is also coaxial to the separator drive shaft. The collar includes a fluid flow path for white liquor from the sleeve to flow to outlet ports 40 on the collar. From these ports, the liquor is discharged onto the chips that overflow the screw conveyor 38. The collar 62 fits around the bottom of the drive shaft 60 and is rotated by the shaft. In addition, the collar may support the paddles 56 and the screw conveyor 38. An annular seal 68, may be provided between the collar and the sleeve 61. The annular seal may be a loose sleeve fitting coated with Teflon (™) or other such coating material.

To enter the pressure vessel 10, white liquor flows through an inlet tube 64 that extends through a vessel wall 66 and to the sleeve 61. The inlet tube 64 comes into the vessel at an angle to the separator drive shaft. The inlet tube 64 is connected to the stationary sleeve 61. The liquor flows through passage(s) in the sleeve and exits the bottom of the sleeve into an open chamber in the collar 62 that leads to the outlet ports 40, 72. The liquor flows out the ports 40 and onto the chips 13 overflowing the screw conveyor. The ports 40 may be equipped with a spray nozzle 70 to uniformly distribute the liquor over the chips.

Other variations to the present invention may include additional ports 72 (see FIG. 2) distributed along the vertical length of the screw conveyor. These additional ports add liquor to the chips as they move upward through the conveyor. Moreover, the ports 72 may extend only along the upper portion of the screw (such as the upper 20% or 30% of the vertical length of the screw conveyor), or the entire length of the screw. By adding liquor while the chips are in the screw, the newly-added liquor can push out (through the screen cylinder 14) the black liquor in the chip slurry. Moreover, the liquor injected through the ports 40 and 72 may be white liquor, filtrate, black liquor and may include additives to enhance the pulping chemistry.

The preferred embodiments of the invention, as now known by the inventors, are fully described here in sufficient detail such that one of ordinary skill in the art is able to make and use the invention using no more than routine experimentation. The embodiments disclosed herein may not be all of the possible embodiments of the invention. Other embodiments of the invention that are within the sprite and scope of the claims are also covered by this patent.

What is claimed is:

1. A method for adding cooking liquor into a vapor phase continuous digester for producing chemical cellulose pulp from cellulose chips comprising:

introducing a slurry of the cellulose chips from a feed system to an inverted top separator in a top vapor phase section of the digester;

distributing the slurry of the cellulose chips from the top separator into the vapor phase section of the digester;

passing liquor through a conduit included with the drive shaft assembly of the top separator, and introducing the liquor from the conduit into the slurry as the slurry flows through the top separator or is distributed from the separator into the vapor phase section.

2. A method for adding cooking liquor as in claim 1 wherein the liquor is introduced through a center shaft of the top separator.

3. A method for adding cooking liquor as in claim 2 wherein the liquor is introduced from the center shaft through outlet ports in the shaft into the slurry.

4. A method for adding cooking liquor as in claim 3 wherein at least one of the outlet ports is on the center shaft above a conveyor for the slurry.

5. A method for adding cooking liquor as in claim 4 wherein at least one of the outlet ports is adjacent the conveyor, and the conveyor is a screw conveyor coaxial to the center shaft.

6. A method for adding cooking liquor as in claim 1 further comprising extracting black cooking liquor from the slurry in the top separator.

7. A method for adding cooking liquor as in claim 1 wherein the liquor is introduced through a lower inlet of a center shaft of the top separator and the slurry is introduced to the top separator through an inlet axially offset from the center shaft.

8. A method for adding cooking liquor as in claim 1 wherein the liquor is introduced through an inlet to an upper portion of a center shaft of the top separator.

9. A method for adding cooking liquor into a vapor phase continuous digester for producing chemical cellulose pulp from cellulose chips, wherein the digester includes a vapor phase continuous digester vessel having a lower section filled with the cellulose chips and an upper gas-filled section and an inverted separator at least partially in said upper section and the separator includes a drive shaft assembly connected to a conveyor and includes a liquid conduit, and said method comprises:

introducing a slurry of the cellulose chips to the inverted top separator in the upper vapor phase section of the digester;

distributing the slurry of the cellulose chips from the top separator into the digester;

passing liquor through the liquid conduit;

introducing liquor from the liquid conduit into the slurry as the slurry flows through the top separator or is distributed from the separator.

10. A method for adding cooking liquor as in claim 9 wherein the slurry is distributed from the top separator into the upper gas-filled section of the digester.

11. A method for adding cooking liquor as in claim 9 wherein the liquid conduit is within a drive shaft and the liquor passes through the drive shaft in the liquid conduit.

12. A method for adding cooking liquor as in claim 9 wherein the drive shaft assembly includes at least one liquor discharge port and introducing liquor includes discharging liquor through the liquor discharge port.

13. A method for adding cooking liquor as in claim 12 wherein the liquid discharge port is a plurality of ports arranged on the drive shaft assembly, and the liquor is introduced from the plurality of ports as the slurry flows through the top separator.

14. A method for adding cooking liquor as in claim 12 wherein the liquor discharge port includes a discharge port above a slurry conveyor in the top separator.

15. A method for adding cooking liquor as in claim 12 wherein the liquor discharge port includes outlet ports adjacent a screw conveyor in the separator.

16. A method for adding cooking liquor as in claim 9 further comprising extracting black cooking liquor from the slurry in the top separator.

17. A method for adding cooking liquor as in claim 9 wherein the liquor is introduced through a lower inlet of a center shaft of the top separator and the slurry is introduced to the top separator through an inlet axially offset from the center shaft.

18. A method for adding cooking liquor as in claim 9 wherein the liquor is introduced through an inlet to an upper portion of a center shaft of the top separator.

19. A method for adding cooking liquor into a vapor phase continuous digester for producing chemical cellulose pulp from cellulose chips, wherein the digester includes a vapor phase continuous digester vessel having a lower section filled with the cellulose chips and an upper gas-filled section and an inverted separator at least partially in said upper section and the separator includes a rotatable drive shaft assembly connected to a conveyor and includes a liquid conduit having an inlet external to the vessel, and said method comprises:

introducing a slurry of the cellulose chips to the inverted top separator in the upper vapor phase section of the digester;

discharging the slurry of the cellulose chips from the top separator into the upper gas-filled section of the digester;

introducing a slurry into the inlet of the liquid conduit and passing liquor through the liquid conduit;

introducing liquor from the liquid conduit into the slurry proximate to the discharge of the slurry from the top separator.

20. A method for adding cooking liquor as in claim 19 wherein the liquor from the liquid conduit is introduced through at least one outlet port arranged on a circumference of a drive shaft of the drive shaft assembly.

* * * * *